United States Patent [19]

Brettschneider et al.

[11] 4,089,311

[45] May 16, 1978

[54] FUEL SUPPLY SYSTEM FOR INTERNAL COMBUSTION ENGINES

[75] Inventors: Johannes Brettschneider, Ludwigsburg; Valerio Bianchi, Hochdorf; Osvaldo Bejerman, Stuttgart; Lorenz Bundesen, Flensburg; Hans Zeller, Grafenau, all of Germany

[73] Assignee: Robert Bosch GmbH, Stuttgart, Germany

[21] Appl. No.: 701,407

[22] Filed: Jul. 8, 1976

[30] Foreign Application Priority Data

Jul. 8, 1975 Germany ..... 2530314

[51] Int. Cl.[2] ..... F02M 7/02

[52] U.S. Cl. ..... 123/119 EC; 123/32 EE; 123/140 MC; 123/140 MP; 60/285; 261/DIG. 67; 261/50 A

[58] Field of Search ..... 123/119 EC, 32 EA, 32 EE, 123/140 MC, 140 MP; 60/276, 285; 261/DIG. 67

[56] References Cited

U.S. PATENT DOCUMENTS

| | | | |
|---|---|---|---|
| 3,606,872 | 9/1971 | Eckert | 123/140 MC |
| 3,782,347 | 1/1974 | Schmidt et al. | 60/276 |
| 3,900,014 | 8/1975 | Bundensen et al. | 123/140 MC |
| 3,923,016 | 12/1975 | Hoshi | 123/32 EE |
| 3,974,813 | 8/1976 | Knapp et al. | 123/119 EC |
| 4,007,720 | 2/1977 | Brettschneider et al. | 123/32 EE |
| 4,010,722 | 3/1977 | Laprade et al. | 123/119 EC |

FOREIGN PATENT DOCUMENTS

| | | | |
|---|---|---|---|
| 2,316,787 | 10/1974 | Germany | 261/DIG. 67 |

*Primary Examiner*—Charles J. Myhre
*Assistant Examiner*—Parshotam S. Lall
*Attorney, Agent, or Firm*—Edwin E. Greigg

[57] ABSTRACT

A fuel supply system for internal combustion engines includes a fuel reservoir adjacent the induction manifold from which fuel is aspirated depending on pressure differences in two separate regions of the manifold.

An electric controller reacts to engine rpm and exhaust gas composition signals to actuate electromagnetic valves in the air conduits leading from the manifold to the fuel reservoir. Various valve opening schedules can be performed depending on the desired fuel mixture.

18 Claims, 11 Drawing Figures

FUEL SUPPLY SYSTEM FOR INTERNAL COMBUSTION ENGINES

BACKGROUND OF THE INVENTION

The invention relates to a fuel supply system for internal combustion engines which includes a fuel container which is kept filled with fuel up to a constant level and which communicates through a tube with the induction tube of the engine. The amount of fuel which is metered out to the air aspirated by the engine is determined by the difference in the pressure of the fuel container and of the induction tube. The pressure in the fuel container can be altered by means of solenoid valves which function under the control of the intermittent sensor voltage of an oxygen sensor located in the exhaust line. These solenoid valves are disposed in the air conduits which lead to the air space above the fuel in the fuel container and permit connecting this air space with different portions of the induction tube in which different pressures prevail.

In order to meet the technical requirements of present day engines, fuel supply systems for internal combustion engines must automatically provide an appropriate fuel-air mixture under all operational conditions of the engine to permit complete combustion and to reduce, as much as possible, any toxic components in the exhaust gas while maintaining maximum power or least fuel consumption. For this purpose, the fuel quantity which is metered out to the engine has to be adapted extremely exactly to each and every operational state of the engine. Thus, the most favorable ratio of air to fuel must be changeable in dependence on motor variables, especially exhaust gas values, and in the fuel metering system described above, this change is effected by changing the pressure in the fuel chamber.

OBJECT AND SUMMARY OF THE INVENTION

It is a principal object of the invention to provide a fuel metering system of the general type described above in which the change of the pressure in the fuel chamber may be made in a manner not requiring expensive structural elements and in a reliable manner.

This object is attained according to the invention by providing that the electromagnetic solenoid valves which are disposed in each air conduit which connects the air space above the fuel chamber with other portions of the engine are cycled in opposing phase.

A favorable feature of the invention is that the basic setting of the fuel-air mixture is made relatively rich and by providing that the fuel-air mixture ratio is controlled in such a manner that, when the sensor voltage of the oxygen sensor exceeds a certain predetermined threshold, the air space above the fuel chamber is connected through a first solenoid valve with the induction tube region in which a low pressure prevails, while, when the sensor voltage falls below the threshold, a second valve opens a conduit which connects the air space in the fuel chamber with the induction tube region in which a higher pressure prevails. It is another feature of the invention that the opening time of the solenoid valves is constant and that the valves are actuated by signals derived from the ignition system of the engine. Yet another feature of the invention is that the opening duration of each valve may be increased by a fixed factor if such a valve receives two sequential opening pulses from the ignition system.

In yet another favorable aspect of the invention, the valves are actuated cyclically and the duty cycle of each valve is made proportional to the output voltage of an integrating circuit which is part of an electronic controller. The input of the integrating circuit is provided in known manner with the oxygen sensor voltage and the output voltage of the integrator increases as long as the sensor voltage exceeds a predetermined threshold, while it decreases when the sensor voltage is smaller than the predetermined threshold. The output voltage of the integrator may be changed cyclically by providing that any change indicated by the sensor voltage is actuated by one of the ignition pulses and takes place over a predetermined length of time, whereas after that predetermined time, the output voltage of the integrator remains constant until the next trigger pulse from the ignition.

Another feature of the invention provides that the sum of the opening times of the cyclically controlled valves is constant and further that when the pressure sources of the engine pulsate, the sum of the opening times of the valves is made smaller than the pulse period and extends over a region which includes the highest pressure difference of the two sources of pressure for the air space in the fuel chamber.

The invention will be better understood as well as further objects and advantages thereof become more apparent from the ensuing detailed specification of four exemplary embodiments of the invention taken in conjunction with the drawing.

DESCRIPTION OF THE PREFERRED EMBODIMENTS

Figure 1:
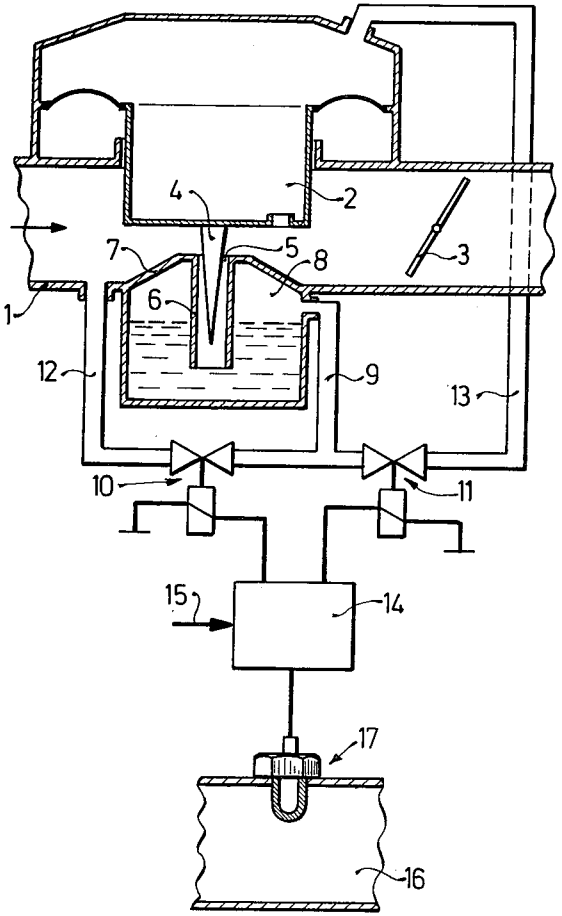
FIG. 1 is a diagram of a first exemplary embodiment of a fuel supply system according to the invention.

Turning now to FIG. 1, there is seen a portion of an induction tube 1 of an internal combustion engine, including an air flow control member 2 and an arbitrarily settable throttle valve 3. The air flow rate control element 2 has a needle-like extension 4 which terminates in a fuel metering location 5 of a conduit 6, thereby controlling the free aperture at the location 5. The conduit 6 extends into a fuel chamber 7 and its end remote from the air flow control element 2 extends below the level of the fuel in the chamber. The air space 8 above the fuel in the fuel chamber 7 communicates through a line 9 with two separate air conduits 12 and 13 which can be obturated by solenoid valves 10 and 11, respectively. The air line 12 leads to the region of the induction tube lying upstream of the air flow rate meter 2, while the air conduit 13 terminates at the narrowest part of the induction tube controlled by the air flow member 2 upstream of the throttle valve 3. In the normal case, when no air flows, the valves 10 and 11 are closed. An electronic controller 14 which includes an integrating operational amplifier exerts control over the solenoids valves and it acts in response to electrical variables which are transduced from operational variables 15 of the engine, for example, the engine rpm and a sensor voltage which is taken from an oxygen sensor 17 located in the exhaust line 16. A suitable valve controller is described in U.S. Pat. No. 3,874,171 whose descriptive portions are hereby incorporated by express reference.

Figure 2:
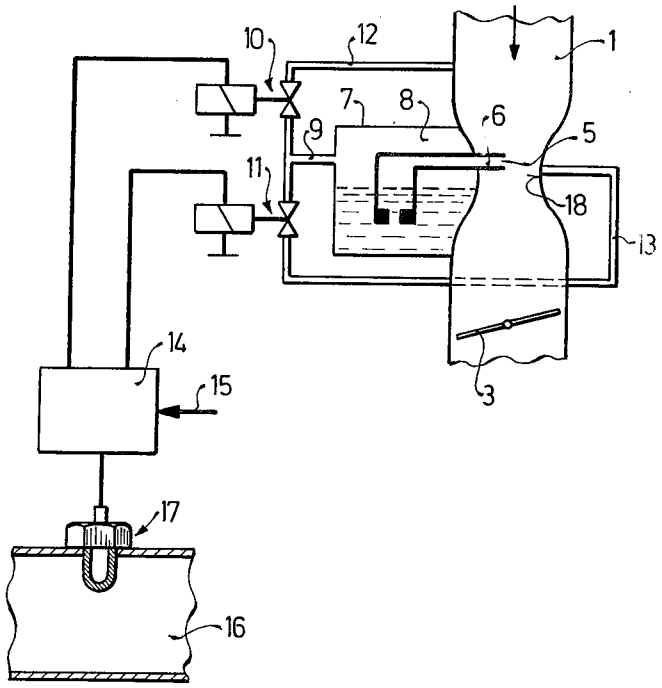
FIG. 2 is a second exemplary embodiment of the invention.

The exemplary embodiment of the invention illustrated in FIG. 2 is substantially similar to that in FIG. 1 with the exception that the air line 13 terminates at the narrowest portion of the venturi cross section 18.

The oxygen sensor 17 disposed in the exhaust line 16 is a little tube closed on one side consisting of a solid electrolyte, for example, sintered zirconium dioxide. Both surfaces of the little tube are covered with evaporated microporous platinum layers which are provided with suitable electrical contacts on which an electrical potential may be impressed. One surface of the tube experiences atmospheric air while the other is exposed to the exhaust gases of the engine.

In known manner, the solid electrolyte becomes conducting for oxygen ions at elevated temperatures such as prevail in the exhaust gas. If the partial pressure of oxygen in the exhaust gas is different from the partial pressure of oxygen in the atmosphere, a potential difference occurs as between the two platinum layers, i.e., between the terminals on the tube, and this potential has a particular characteristic which corresponds to the air number $\lambda$ which is defined as proportional to the ratio of air to fuel. This potential difference across the two surfaces of the sensor is a logarithmic function of the quotient of the partial pressures of oxygen on the two sides of the solid electrolyte.

Thus the sensor voltage changes abruptly in the vicinity of the point when the air number $\lambda = 1$. When $\lambda > 1$ unused oxygen will suddenly appear in the exhaust gas. Because the output potential of the oxygen sensor 17 depends very heavily on the air number $\lambda$, this sensor is very suitable for controlling the above-mentioned solenoid valves 10 and 11. When the air number $\lambda < 1$, the sensor potential is high, while it is low when $\lambda > 1$.

Figure 3:
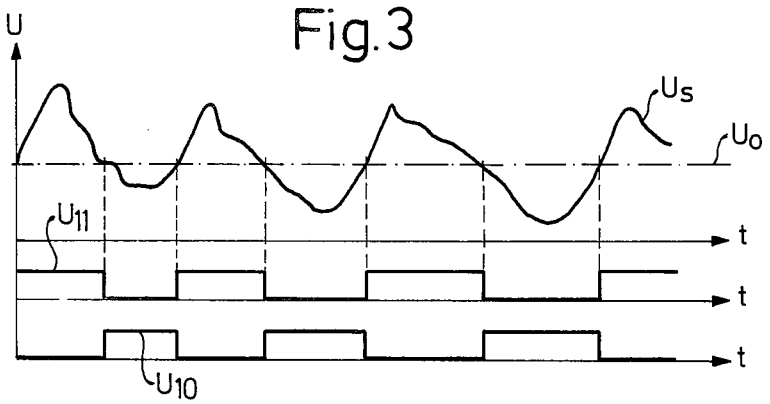
FIGS. 3–9 are diagrams which include timing information related to various possibilities for controlling the fuel supply system according to the invention.

FIGS. 3–9 are diagrams which are for illustration of the various control possibilities of valves 10 and 11. FIG. 3 is a diagram of a voltage U as a function of $t$. The upper curve in FIG. 3 indicates the sensor voltage $U_s$ as a function of time and is seen to fluctuate about a predetermined constant value $U_o$ indicated by a dash-dotted line. If the basic setting of the fuel-air ratio delivered by the fuel supply system is made rich and if the sensor voltage $U_s$ is larger than the threshold voltage $U_o$, the fuel-air mixture is too rich and the valve 11 will be opened so that the air space in the fuel container 7 experiences a pressure decrease and a smaller quantity of fuel is aspirated at the metering aperture 5. If the sensor voltage $U_s$ drops below the threshold $U_o$, the valve 11 is closed and the valve 10 is opened so that the air space in the fuel container is connected with that portion of the induction tube in which a higher pressure prevails so that, due to the greater pressure difference at the metering aperture 5, a larger amount of fuel is aspirated and the fuel-air mixture is thereby enriched. In this manner, the pressure in the air space 8 of the fuel container 7 is changed until the mixture is such that the air number $\lambda$ is approximately 1 and such a mixture has been shown to be particularly favorable and corresponds to a stoichiometric mixture of air and fuel.

Figure 4:
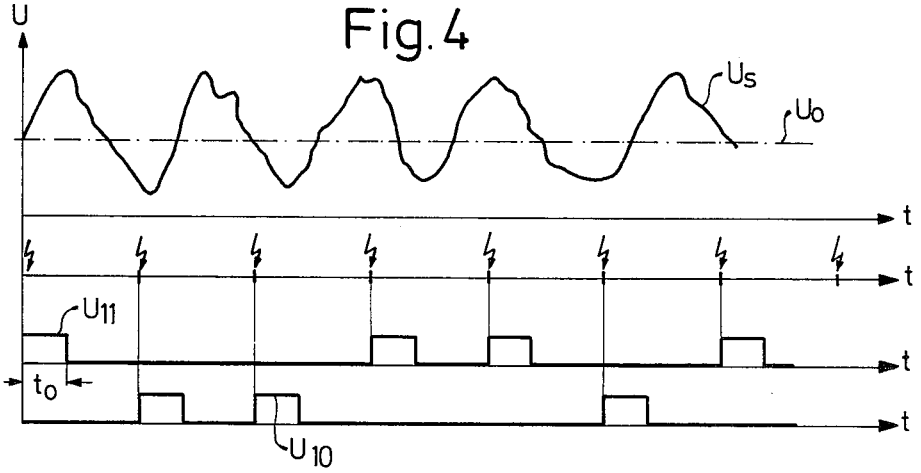

The valve operating voltages $U_{11}$ and $U_{10}$ are shown in the two lower diagrams of FIG. 3. Another variant possibility of controlling the valves is indicated in FIG. 4, in which the opening pulses for the valves are the ignition pulses which may also be derived from rpm signals and wherein the opening time $t_o$ of the valves 10 and 11 is constant.

Figure 5:
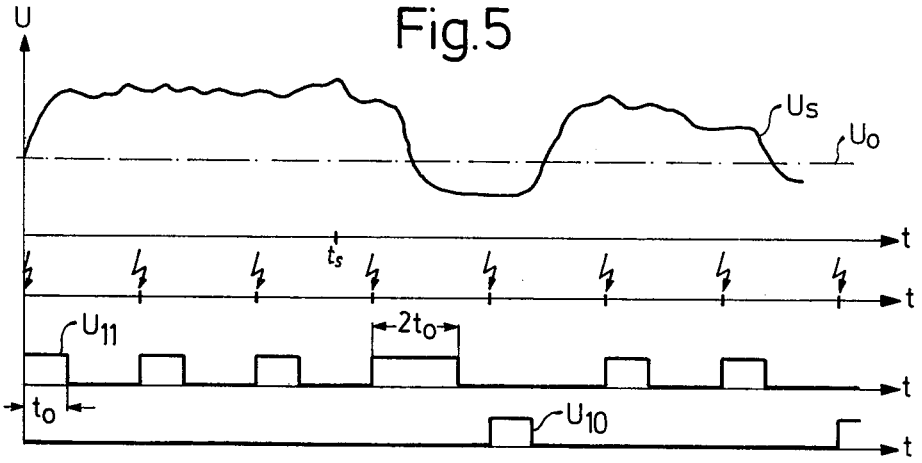

FIG. 5 shows yet another type of valve control in which the opening time $t_o$ of each valve 10, 11 is increased by a predetermined factor, for example, doubled in case this valve is opened consecutively by at least two sequential ignition pulses. Thus for example, if two opening pulses for the same valve occur in an arbitrarily settable time span $t_s$, the opening time of that particular valve may be doubled, for example at the occurrence of a pulse after a time $t_s$. Since the information about the magnitude of deviation from the air number $\lambda$ cannot be derived directly from the air sensor voltage, a repeated opening of a valve is assumed to imply a large deviation of the air number $\lambda$ from its nominal value and it is thus compensated for by a more rapid control due to a prolongation of the opening time of that valve.

In the variant control methods illustrated in FIGS. 6 to 9, the valves 10 and 11 are cycled in opposite phase. The duty cycles defined by $T_{10} = t_{10}/(t_{10} + t_{11})$ and $T_{11} = t_{11}/(t_{10} + t_{11})$ define the periods of time in which the air chamber 8 is connected to the higher or lower induction tube pressure respectively, and they thus create in the air chamber a pressure $P_1$ whose average value corresponds to a value between the upper and lower induction tube pressures in proportion to the duty cycle ratio. This serves to create at the metering aperture 5 an effective pressure difference of such magnitude as to produce an air number $\lambda$ of approximately 1. The duty cycle ratios $T_{10}$ and $T_{11}$ are proportional to the output voltage of the integrator contained in the electronic controller 14 and the output voltage increases, for example, as long as the sensor voltage $U_s$ is greater than the threshold voltage $U_o$ and it decreases in the reverse case. An electric circuit which may be used for this type of control is described in the U.S. Pat. No. 3,874,171.

Figure 6:
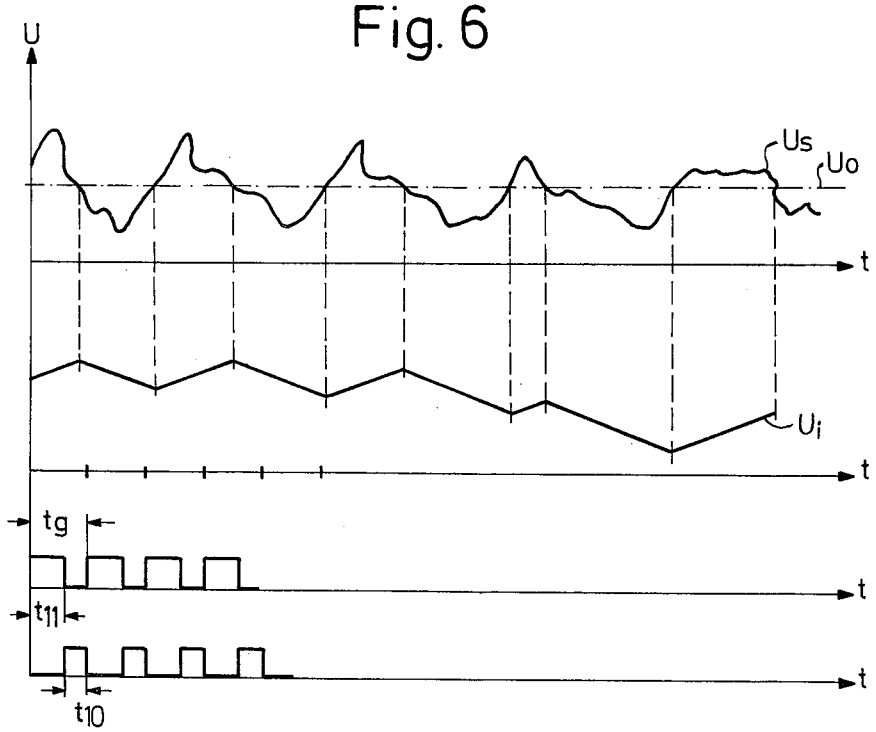

FIG. 6 shows the output voltage of the integrator $U_i$ as a function of time which, in turn, defines the duty cycle ratio of the valves 10 and 11, respectively, whereby the entire period $t_g = t_{10} + t_{11}$ is kept constant.

Figure 7:
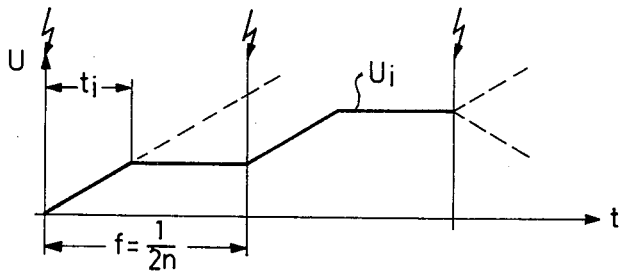

FIG. 7 illustrates a possibility of changing the output voltage $U_i$ of the integrator cyclically, i.e., any change induced by the sensor voltage is initiated by the ignition pulses, i.e., at a frequency $f = 2n$ and then proceeds during a predetermined time period $t_i$ after which the output voltage $U_i$ until the next ignition pulse. This results in an average increase of the output voltage of the integrator proportional to the rpm. This method is described in U.S. Pat. No. 3,875,907.

Inasmuch as the oxygen sensor delivers its information at the operating frequency of the engine (for example in a four cylinder, four cycle engine, $f = 2n$), it could be useful to so control the change of the integrator output voltage that the same change of $\lambda$ takes place in any rpm-dependent cycle period $T_n = \frac{1}{2}n$.

The following relation holds:

$$\Delta\lambda = \frac{d\lambda}{dt} \cdot T_n = \frac{du_i}{dt} \cdot T_n \cdot \frac{dT}{du_i} \quad \frac{dp_1}{dT} \quad \frac{d\lambda}{dp1} = \text{const.}$$

when $dT \sim du_i$, $dp_l \sim dT$ and $d\lambda \sim dp_l$, then $$\frac{dT}{du_i} \cdot \frac{dp_1}{dT} \cdot \frac{d\lambda}{dp_1} = \text{const.}$$

where T is the duty cycle (keying ratio) of the valve control pulses and is equal to the valve opening time divided by the engine period. In order to obtain the same response time for each cycle, the duty ratio $T = T_{11} = t_{11}/T_n$ may be generated by an output voltage of the integrator which changes in proportion to rpm. During the transition from one operational state of the engine to another having the same mixture ratio but different rpm, this duty cycle ratio must be maintained, i.e., $t_{11} \sim 1/n$. When $du_i/dt \sim n$ holds, $\Delta\lambda \sim n \cdot \frac{1}{2}n \cdot \text{const} = \text{const}$.

Figure 8:
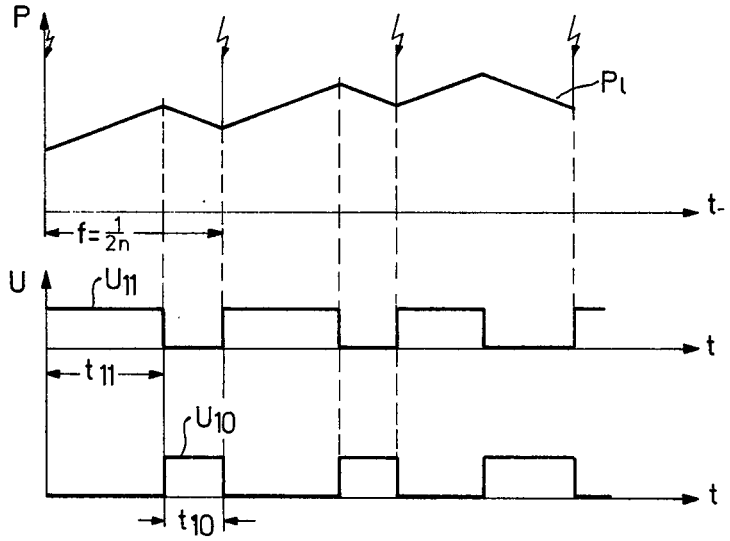

FIG. 8 shows the air chamber pressure $p_1$ for valves 10 and 11 actuated at the ignition frequency and the duty cycle ratio is determined as discussed above by an rpm-proportional output voltage of the integrator.

Figure 9:
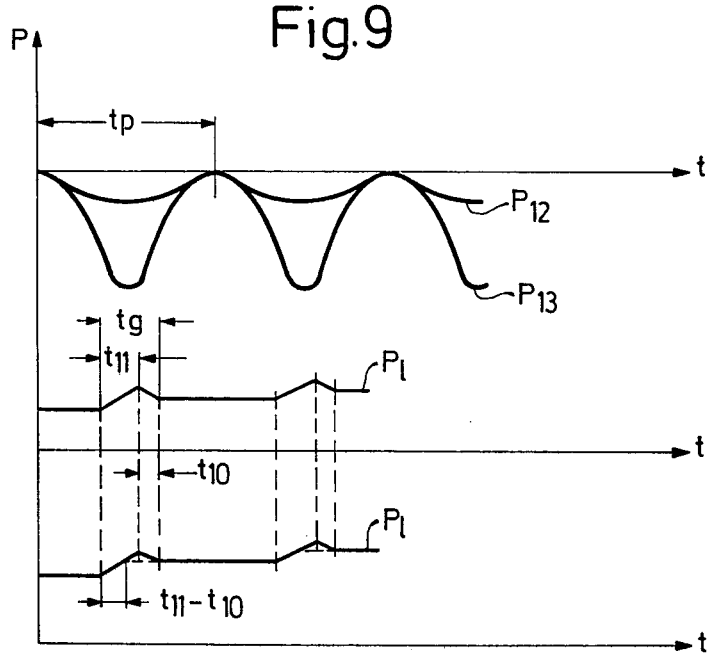

FIG. 9 illustrates that it may be suitable to make the sum of the opening times of the valves 10 and 11 smaller than the pulse time $t_p$ when the pressure sources for the conduits 12 and 13 pulsate in the same phase, for example as do the pressures in the various regions of the induction tube of an engine. It is then suitable to place the operating domain of the valves in a region of maximum pressure difference between the two pressure sources. This brings the further advantage of preventing disturbances during the overlapping opening time of the valves.

A particularly advantageous possibility to actuate the valves is illustrated in the lower part of FIG. 9 which shows a curve illustrating the theoretical difference of the output times $t_{11} - t_{10}$ determined by the output voltage from the integrator and in which only the valve 11 which has a theoretically longer opening time $t_{11}$ is being opened during the difference $t_{11} - t_{10}$.

This manner of construction avoids the situation where the pressure in the chamber 8 is lowered too far by the valve 11 and must then be built back up through the valve 10.

Figure 10:
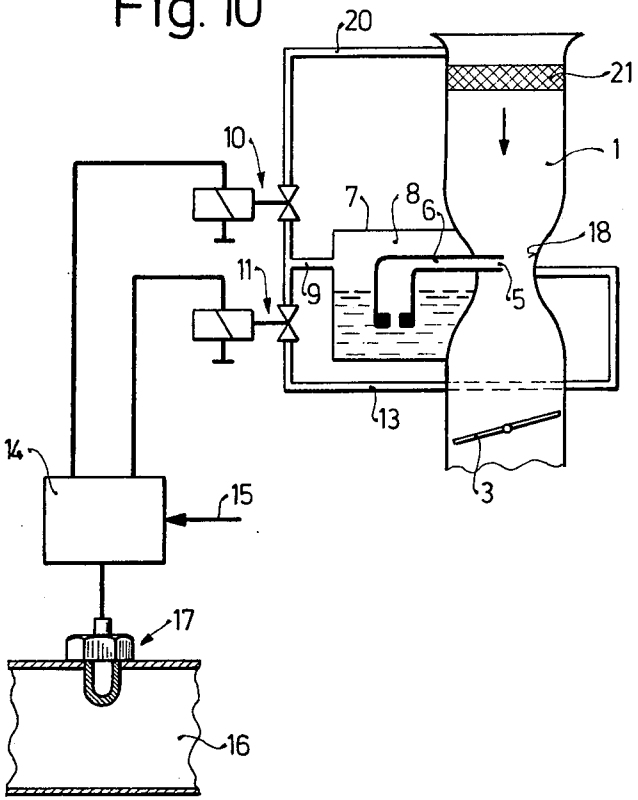
FIG. 10 is a schematic diagram of a third exemplary embodiment of the fuel supply system of the invention.

FIG. 10 illustrates a further embodiment of the invention which provides an increase of the pressure difference of the induction tube pressures used for controlling the air pressure $p_1$. This is done by tapping off the larger pressure for the chamber 8 through a line 20 upstream of an air filter 21 in the induction tube. This construction provides a large pressure difference for controlling the fuel-air mixture due to the pressure drop across the air filter and, for example, the Venturi vacuum.

Figure 11:
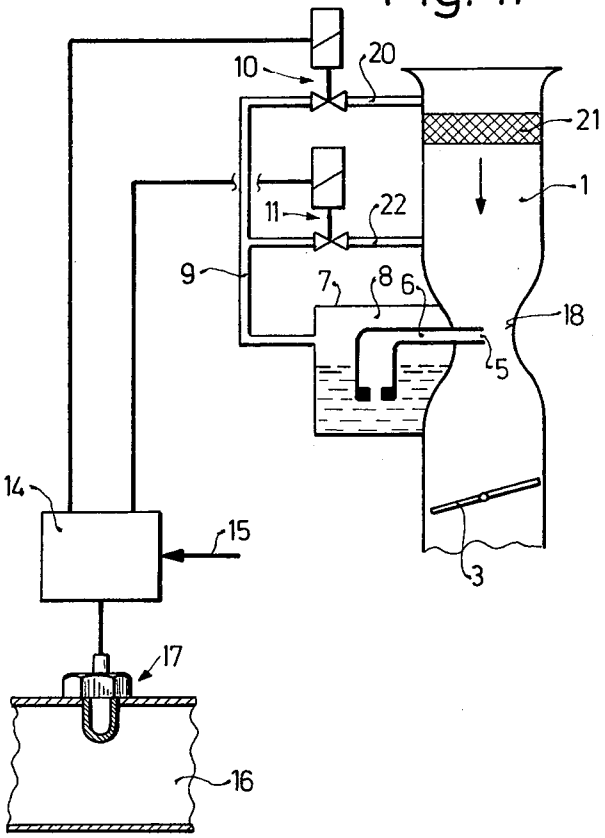
FIG. 11 is a schematic diagram of a fourth exemplary embodiment of the invention.

In all three embodiments of FIGS. 1, 2 and 10, it is generally required to make the basic setting of the fuel-air mixture rich. But when large amounts of mixture are flowing, (high Venturi vacuum) the air space 8 may experience a vacuum which would result in evaporation of the fuel components having a low boiling point and thus could produce disturbances in the pressure control. It may therefore be suitable, as illustrated in FIG. 11, to employ the pressure drop across the air filter 21 for controlling the pressure in the air chamber 8. For this purpose, the air chamber 8 may be connected via a line 9 with the air line 20 upstream of the filter 21 and secondly through a line 22 with the induction tube downstream of the air filter 21. The air lines 20 and 22 are controlled, respectively, by the solenoid valves 10 and 11. Since this type of mechanism can serve only to enrich the fuel-air mixture, the basic setting of the fuel supply system must therefore be made lean.

The solenoid valves 10 and 11 could also be operated in opposite phase by a common magnet as explained in the U.S. Pat. No. 3,974,813.

The foregoing description relates to preferred exemplary embodiments and other embodiments and variants of the invention are possible within the spirit and scope thereof, the latter being defined by the appended claims.

Details of the electronic controller 14 are known by one or more of the following U.S. Pat. Nos.:

3,874,171
3,782,347
3,759,232
3,745,768
3,483,851 and the allowed application Ser. No. 392,659, the descriptive portions of which are incorporated by express reference.

What is claimed is:

1. A fuel supply system for an internal combustion engine, said engine including an induction manifold and an exhaust manifold, comprising:

a fuel reservoir connected by at least two separate conduits with different respective regions of said induction manifold;

electromagnetic valve means disposed in each of said conduits for controlling the air pressure in said reservoir;

an electric controller for actuating said electromagnetic valve means in mutually opposed phase relationship; and an oxygen sensor disposed in said exhaust manifold for generating a signal for said controller and wherein said controller includes means for generating a set-point signal, means for comparing said set-point signal with the signal from said oxygen sensor and means for opening one of the electromagnetic valves in said conduit leading to a region of relatively lower pressure in said induction manifold when said signal from said oxygen sensor is higher than said set-point signal and for opening the other of said electromagnetic valves in said conduit leading to a region of relatively higher pressure in said induction manifold when said signal from said oxygen sensor is lower than said set-point signal, and wherein said electric controller is connected to be triggered by the ignition pulses of the engine to open said electromagnetic valves for a constant period of time.

2. A fuel supply system as defined by claim 1, wherein one of said conduits connects an air space in said fuel reservoir with an induction manifold region upstream of an air filter and wherein the other of said conduits connects said air space with the narrowest flow cross section in said induction manifold upstream of the throttle valve of the engine.

3. A fuel supply system as defined by claim 1, wherein an air space in said fuel reservoir may be coupled by said conduit with induction manifold regions respectively upstream and downstream of an air filter and wherein the basic setting of the fuel-air mixture delivered by said fuel supply system is lean.

4. A fuel injection system as defined by claim 3, including means for altering the opening time of each of said electromagnetic valves whenever one of said valves is opened in succession by two successive engine ignition pulses.

5. A fuel supply system as defined by claim 1, wherein said electric controller includes means for cyclic actuation of said electromagnetic valves and wherein the duty cycle of said electromagnetic valves is proportional to the output voltage of integrating means in said controller, said integrating means receiving said signal from said oxygen sensor; whereby the output voltage of said integrator increases as long as said sensor signal is greater than a predetermined set point voltage while said output voltage of said integrator decreases whenever the sensor signal is smaller than a predetermined set point voltage.

6. A fuel supply system as defined by claim 5, wherein said controller includes means for changing the output voltage from said integrator in dependence on the signal from said oxygen sensor and initiated by the ignition pulses and is maintained over a predetermined time interval $t_i$ and that thereafter the output voltage remains constant until the arrival of the next ignition pulse.

7. A fuel injection system as defined by claim 5, wherein the sum of the opening times of the cyclically actuated electromagnetic valves is constant.

8. A fuel supply system as defined by claim 7, wherein the pressure in said intake manifold pulsates cyclically and the sum of the opening times of said electromagnetic valves is smaller than the period of pulsation of said pulsating pressures and takes place when the pressure difference between the two regions in said induction manifold is the greatest.

9. A fuel supply system as defined by claim 5, wherein said electromagnetic valves are cycled at the ignition frequency and their duty cycle is determined by the changing output voltage from said integrator which changes in proportion to engine rpm.

10. A fuel supply system as defined by claim 5, including means for calculating the difference of the opening times of said electromagnetic valves as determined by the output voltage from said integrator and for opening the valve having the longer calculated opening time during the calculated time difference.

11. A method for controlling the fuel supply of an internal combustion engine, said engine including an induction manifold, an exhaust manifold, and a fuel reservoir connected by at least two separate conduits with different respective regions of said induction manifold, comprising the steps of:

providing an electromagnetic valve in each of said conduits and providing a controller for actuating said electromagnetic valves;

actuating said electromagnetic valves in mutually opposed phase relationship;

providing an exhaust gas oxygen sensor for generating a control signal for said controller adjusting the basic setting of said controller to deliver a rich fuel-air mixture;

generating a set-point voltage;

comparing the signal from said oxygen sensor with said set-point signal;

energizing a first one of said electromagnetic valves which opens a conduit to a region of said manifold at relatively lower pressure whenever said oxygen sensor signal is greater than said set-point signal and energizing a second of said electromagnetic valves which opens a conduit to a region of said manifold at relatively higher pressure whenever said oxygen sensor signal is smaller than said set-point signal;

keeping constant the opening times of said first and second electromagnetic valves; and triggering the opening cycles for said valves with pulses derived from the ignition pulses of said internal combustion engine.

12. A method as defined by claim 11, comprising the further step of:

increasing the opening time of any one of said electromagnetic valves whenever said any one valve is being opened at least twice in succession by two successive ignition pulses.

13. A method as defined in claim 11, comprising the further steps of:

actuating said electromagnetic valves in cyclical manner;

providing an integrating circuit in said controller and feeding to said integrator circuit a signal from said oxygen sensor;

adjusting the duty cycle of said electromagnetic valves in proportion to the output voltage from said integrating circuit;

whereby the output voltage from said integrator increases whenever the signal from said oxygen sensor is smaller than a set-point voltage.

14. A method as defined by claim 13, comprising the steps of:

triggering cyclical changes in the output voltage of said integrator by means of said ignition pulses;

causing said output voltage to change for a predetermined time $t_i$; and keeping said output voltage constant until the arrival of the next ignition pulse.

15. A method as defined by claim 13, comprising the step of keeping constant the sum of the opening times of said cyclically actuated electromagnetic valves.

16. A method as defined by claim 13, comprising the step of:

making the sum of the opening times of said electromagnetic valves smaller than the period of fluctuations of pressure from two pressure sources fluctuating in step; and placing the opening time of said valves to correspond with the occurrence of maximum pressure difference between said regions of higher and lower pressure.

17. A method as defined by claim 13, wherein the duty cycle of said electromagnetic valves is determined by the output voltage from said integrating circuit and said output voltage is changed in accordance with the rpm of the engine.

18. A method as defined by claim 13, comprising the additional steps of:

forming the difference of the opening times of said electromagnetic valves theoretically defined by the output voltage from said integrating circuit; and opening only that valve which has the theoretically longer opening time during the time interval defined by said difference of opening times.

* * * * *